US005401282A

United States Patent [19]

Leininger et al.

[11] Patent Number: 5,401,282

[45] Date of Patent: Mar. 28, 1995

[54] PARTIAL OXIDATION PROCESS FOR PRODUCING A STREAM OF HOT PURIFIED GAS

[75] Inventors: Thomas F. Leininger, Chino Hills; Allen M. Robin, Anaheim; James K. Wolfenbarger, Torrance, all of Calif.; Robert M. Suggitt, Wappingers Falls, N.Y.

[73] Assignee: Texaco Inc., White Plains, N.Y.

[21] Appl. No.: 77,270

[22] Filed: Jun. 17, 1993

[51] Int. Cl.[6] ..... C10J 3/46

[52] U.S. Cl. ..... 48/197 R; 48/198.3; 48/200; 48/202; 48/206; 48/DIG. 2; 60/39.02; 252/373; 423/230

[58] Field of Search ..... 48/197 R, 203, 206, 48/209, 210, 212, 215, 198.3, 200, 201, DIG. 2, DIG. 7; 252/373; 60/39.02; 423/230, 139.1, 240 S

[56] References Cited

U.S. PATENT DOCUMENTS

| | | | |
|---|---|---|---|
| 3,998,609 | 12/1976 | Crouch et al. | 48/45 |
| 4,081,253 | 3/1978 | Marion | 48/197 R |
| 4,121,912 | 10/1978 | Barber et al. | 48/197 R |
| 4,202,167 | 5/1980 | Suggitt et al. | 60/39.02 |
| 4,326,856 | 4/1982 | Muenger et al. | 252/373 |
| 4,328,008 | 5/1982 | Muenger et al. | 252/373 |
| 4,436,530 | 3/1984 | Child et al. | 48/197 R |
| 4,613,344 | 9/1986 | Henrich et al. | 48/77 |
| 4,884,396 | 12/1989 | Miyamoto et al. | 60/39.12 |
| 5,213,587 | 5/1993 | Ekstrom et al. | 48/197 R |
| 5,251,433 | 10/1993 | Wallace | 60/39.05 |

*Primary Examiner*—Peter Kratz

*Attorney, Agent, or Firm*—George J. Darsa; Kenneth R. Priem; Jeffrey M. Greenman

[57] ABSTRACT

A partial oxidation process for the production of a stream of hot clean gas substantially free from particulate matter, ammonia, alkali metal compounds, halides and sulfur-containing gas for use as synthesis gas, reducing gas, or fuel gas. A hydrocarbonaceous fuel comprising a solid carbonaceous fuel with or without liquid hydrocarbonaceous fuel or gaseous hydrocarbon fuel, wherein said hydrocarbonaceous fuel contains halides, alkali metal compounds, sulfur, nitrogen and inorganic ash containing components, is reacted in a gasifier by partial oxidation to produce a hot raw gas stream comprising $H_2$, CO, $CO_2$, $H_2O$, $CH_4$, $NH_3$, HCl, HF, $H_2S$, COS, $N_2$, Ar, particulate matter, vapor phase alkali metal compounds, and molten slag. The hot raw gas stream from the gasifier is split into two streams which are separately deslagged, cleaned and recombined. Ammonia in the gas mixture is catalytically disproportionated into $N_2$ and $H_2$. The ammonia-free gas stream is then cooled and halides in the gas stream are reacted with a supplementary alkali metal compound to remove HCl and HF. Alkali metal halides, vaporized alkali metal compounds and residual fine particulate matter are removed from the gas stream by further cooling and filtering. The sulfur-containing gases in the process gas stream are then reacted at high temperature with a regenerable sulfur-reactive mixed metal oxide sulfur sorbent material to produce a sulfided sorbent material which is then separated from the hot clean purified gas stream having a temperature of at least 1000° F.

28 Claims, 1 Drawing Sheet

PARTIAL OXIDATION PROCESS FOR PRODUCING A STREAM OF HOT PURIFIED GAS

The Government of the United States of America has rights in this invention pursuant to Contract No. DE-FC21-87MC23277 awarded by the U.S. Department of Energy.

FIELD OF THE INVENTION

This invention relates to a partial oxidation process for producing hot clean synthesis, reducing, or fuel gas substantially free from entrained particulate solids and gaseous impurities including ammonia, halides, vapor phase alkali metal compounds, and sulfur.

BACKGROUND OF THE INVENTION

The partial oxidation process is a well known process for converting liquid hydrocarbonaceous and solid carbonaceous fuels into synthesis gas, reducing gas, and fuel gas. See coassigned U.S. Pat. Nos. 3,988,609; 4,251,228, 4,436,530, and 4,468,376 for example, which are incorporated herein by reference. The removal of fine particulates and acid-gas impurities from synthesis gas is described in coassigned U.S. Pat. Nos. 4,052,175, 4,081,253, and 4,880,439; and in U.S. Pat. Nos. 4,853,003; 4,857,285; and 5,118,480 which are all incorporated herein by reference. However, the aforesaid references, as a whole, do not teach nor suggest the subject process for the production of hot clean synthesis gas, reducing gas, and fuel gas which are substantially free from particulate matter, ammonia, halides, alkali metal compounds, and sulfur-containing gases. By the subject process, synthesis gas, reducing gas, and fuel gas having a temperature in the range of about 1000° F. to 1300° F. are produced. Gas produced by the subject process for burning, e.g., fuel gas in the combuster of a gas turbine, will not contaminate the atmosphere. Gas produced for use as a synthesis gas will not deactivate the synthesis catalyst.

SUMMARY

The subject process relates to a partial oxidation process for the production of a stream of hot clean gas substantially free from particulate matter, ammonia, halides, alkali metal compounds, and sulfur-containing gases for use as synthesis gas, reducing gas, or fuel gas comprising:

(1) reacting a hydrocarbonaceous fuel comprising a solid carbonaceous fuel with or without liquid hydrocarbonaceous fuel or gaseous hydrocarbon fuel, wherein said fuel contains halide, alkali metal compounds, sulfur, nitrogen and inorganic ash containing components, and said fuel is reacted with a free-oxygen containing gas in a free-flow vertical refractory lined partial oxidation gas generator to produce a hot raw gas stream having a temperature in the range of about 1800° F. to 3000° F. and comprising $H_2$, CO, $CO_2$, $H_2O$, $CH_4$, $NH_3$, HCl, HF, $H_2S$, COS, $N_2$, Ar and containing particulate matter, vapor phase alkali metal compounds, and molten slag;

(2) splitting the stream of hot raw gas from (1) into two separate gas streams A and B; wherein the volumetric ratio of raw gas stream A to raw gas stream B is in the range of about 19.0–1.0 to 1.0;

(3) introducing hot raw gas stream A at a temperature in the range of about 1800° F. to 3000° F. into a gas deslagging zone, removing molten slag and a slip-stream of hot raw gas from said gas deslagging zone and separating said molten slag from said slip-stream of hot raw gas in a gas quenching zone to produce a quenched slag-free stream of raw gas G; and removing a hot raw gas stream E substantially free from particulate matter and molten slag from said gas deslagging zone;

(4) quenching raw gas stream B in water, separating out slag and particulate matter, and separating a clean stream of water-saturated raw gas C from the quench water;

(5) dewatering and demisting raw gas stream C to produce raw gas stream D; and mixing together streams of raw gas D and E to produce raw gas stream H at a temperature in the range of about 1700° F. to 2300° F.; and cooling raw gas stream H by indirect heat exchange to a temperature in the range of about 1500° F. to 1850° F.;

(6) mixing together raw gas streams G and H to produce raw gas stream I having a temperature in the range of about 1475° F. to 1800° F. and catalytically disproportionating the ammonia in gas stream I into nitrogen and hydrogen, thereby producing ammonia-free gas stream J; cooling the resulting gas stream J to a temperature in the range of about 1000° F. to 1300° F.; and introducing a supplementary alkali metal compound into the cooled gas mixture J to react with the gaseous halides present in said gas stream; cooling and filtering the resulting process gas stream, and separating therefrom alkali metal halides, any remaining alkali metal compounds, and any remaining particulate matter; and (7) contacting said cooled and filtered gas stream from (6) with a sulfur reactive oxide containing mixed metal oxide sorbent in a sulfur-removal zone, wherein the sulfur-containing gases in said cooled and filtered gas stream from (6) react with said sulfur reactive oxide containing mixed metal oxide sorbent to produce a sulfided sorbent material; and separating said sulfided sorbent material from said cooled and filtered gas stream to produce a clean gas stream substantially free from ammonia, alkali metal compound, halides, sulfur and having a temperature of at least 1000° F.

BRIEF DESCRIPTION OF THE DRAWING

The invention will be further understood by reference to the accompanying drawing. The drawing, designated as FIG. 1, is a schematic representation of an embodiment of the process.

DESCRIPTION OF THE INVENTION

Figure 1:
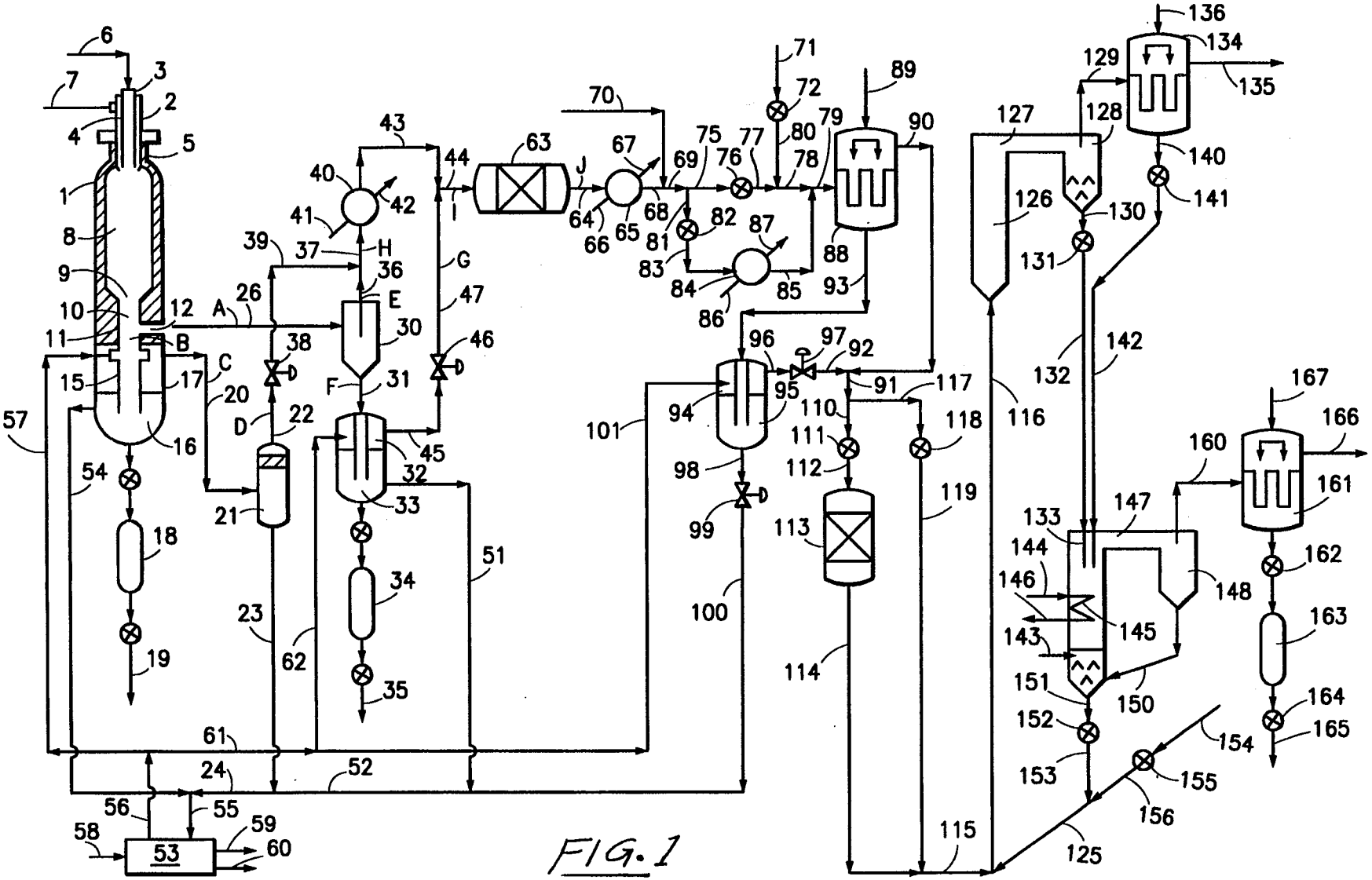

The Texaco partial oxidation gasifier produces raw synthesis, fuel, or reducing gas at temperatures on the order of 1800° to 3000° F. In conventional processes, in order to remove certain contaminants in the stream of raw gas from the gas generator, such as various sulfur species, all of the raw gas produced is cooled down to ambient temperatures or below, as required by the solvent absorption process. Both indirect and direct contact heat exchange methods have been used to accomplish this cooling. However, in all cases, the water in the gas stream is condensed and much of its heat of evaporation is lost. In order to avoid this thermal inefficiency, by the subject process all contaminants are removed from the stream of gas at temperatures well above the adiabatic saturation temperature of the gas. The gas may still be cooled in order to be handled easily, but only to approximately 800° F. to 1800° F., rather than to ambient temperature. Further, in comparison with prior art low temperature gas purification processes, there are larger energy savings with applicants' high temperature gas purification process since the purified gas stream is already hot, and, accordingly, does not require heating prior to introduction into the combustor of a gas turbine for the production of mechanical and/or electrical power. Similarly, when used as a synthesis gas, the process gas stream is already hot.

In the subject process, first a continuous stream of raw gas is produced in the refractory lined reaction zone of a separate downflowing, free-flow, unpacked, noncatalytic, partial oxidation gas generator. The gas generator is preferably a refractory lined vertical steel pressure vessel, such as shown in the drawing, and described in coassigned U.S. Pat. No. 2,992,906 issued to F. E. Guptill, Jr., which is incorporated herein by reference.

A wide range of combustible solid carbonaceous fuels containing impurities comprising halide, sulfur, nitrogen, and inorganic ash-containing components are reacted in the gas generator with a free-oxygen containing gas in the presence of a temperature moderating gas to produce the product gas. For example, the hydrocarbonaceous fuel feedstream may comprise a solid carbonaceous fuel with or without a liquid hydrocarbonaceous fuel or a gaseous hydrocarbon fuel. The expression A with or without B or C means any one of the following: A, A and B, or A and C. The various types of hydrocarbonaceous fuel may be fed to the partial oxidation gasifier in admixture, or each type of fuel may be fed through a separate passage in a conventional annulus type burner.

The term "solid carbonaceous fuel" as used herein to describe various suitable feedstocks is intended to include (1) pumpable slurries of solid carbonaceous fuels, such as coal, lignite, particulate carbon, petroleum coke, concentrated sewer sludge, and mixtures thereof; and (2) gas-solid suspensions, such as finely ground solid carbonaceous fuels dispersed in either a temperature-moderating gas or in a gaseous hydrocarbon. The solid carbonaceous fuel may have a sulfur content in the range of about 0.1 to 10 weight percent, a halide content in the range of about 0.01 to 1.0 weight percent, and a nitrogen content in the range of about 0.01 to 2.0 weight percent. The sulfur containing impurities may be present as sulfides and/or sulfates of sodium, potassium, magnesium, calcium, iron, aluminum, silicon, and mixtures thereof. The halide impurities may be chlorine and/or fluorine compounds of sodium, potassium, magnesium, calcium, silicon, iron and aluminum. The nitrogen may be present as nitrogen containing inorganic or organic compounds. The ash or slag may be present as aluminosilicate glass, with minor amounts of the oxides of Al, Si, Fe, and Ca. In addition, a relatively minor amount of vanadium compounds may be present in petroleum based feedstocks. The ash or slag content may be in the range of about 0.1 to 25 weight percent. Molten slag comprises melted ash. The term "and/or" is used herein in its usual manner. For example A and/or B means either A or B or A and B.

Gaseous hydrocarbon fuels, as used herein to describe suitable gaseous feedstocks, include methane, ethane, propane, butane, pentane, natural gas, water-gas, coke-oven gas, refinery gas, acetylene tail gas, ethylene off-gas, synthesis gas, and mixtures thereof. Both gaseous, solid, and liquid feeds may be mixed and used simultaneously and may include paraffinic, olefinic, naphthenic, and aromatic compounds as well as bituminous liquids and aqueous emulsions of liquid hydrocarbonaceous fuels, containing about 10 to 40 wt. % water.

Substantially any combustible carbon containing organic material, or slurries thereof, may be included within the definition of the term "hydrocarbonaceous". Suitable liquid hydrocarbonaceous feedstocks include liquefied petroleum gas, petroleum distillates and residues, gasoline, naphtha, kerosine, crude petroleum, asphalt, gas oil, residual oil, tar sand and shale oil, coal oil, aromatic hydrocarbons (such as benzene, toluene, xylene fractions), coal tar, cycle gas oil from fluid-catalytic-cracking operation, furfural extract of coker gas oil, tire-oil, and mixtures thereof.

Also included within the definition of the term "hydrocarbonaceous" are oxygenated hydrocarbonaceous organic materials including carbohydrates, cellulosic materials, aldehydes, organic acids, alcohols, ketones, oxygenated fuel oil, waste liquids, and by-products from chemical processes containing oxygenated hydrocarbonaceous organic materials and mixtures thereof.

The solid carbonaceous feed may be at room temperature, or it may be preheated to a temperature up to as high as about 600° to 1200° F. The solid carbonaceous feed may be introduced into the burner as a liquid slurry or in an atomized suspension with a temperature moderator. Suitable temperature moderators include $H_2O$, $CO_2$-rich gas, a portion of the cooled clean exhaust gas from a gas turbine employed downstream in the process, by-product nitrogen from the air separation unit to be further described, and mixtures of the aforesaid temperature moderators.

The use of a temperature moderator to moderate the temperature in the reaction zone depends in general on the carbon to hydrogen ratio of the feedstock and the oxygen content of the oxidant stream. A temperature moderator is generally not required with aqueous slurries of solid carbonaceous fuels; however, generally one is used with substantially pure oxygen and a dry hydrocarbonaceous fuel. When a $CO_2$-containing gas stream, e.g., at least about 3 mole percent $CO_2$ (dry basis) is used as the temperature moderator, the mole ratio ($CO/H_2$) of the effluent product stream may be increased. As previously mentioned, the temperature moderator may be introduced in admixture with either or both reactant streams. Alternatively, the temperature moderator may be introduced into the reaction zone of the gas generator by way of a separate conduit in the fuel burner.

When comparatively small amounts of $H_2O$ are charged to the reaction zone, the $H_2O$ may be mixed with either the solid carbonaceous feedstock, the free-oxygen containing gas, the temperature moderator, or combinations thereof. The weight ratio of water to hydrocarbonaceous fuel may be in the range of about 0.1 to 5.0, such as about 0.2 to 0.7.

The term "free-oxygen containing gas," as used herein is intended to include air, oxygen-enriched air, i.e., greater than 21 mole percent oxygen, and substantially pure oxygen, i.e., greater than 90 mole percent oxygen (the remainder comprising $N_2$ and rare gases). Free-oxygen containing gas may be introduced into the burner at a temperature in the range of about ambient to 1800° F. The ratio of free oxygen in the oxidant to carbon in the feedstock (O/C, atom/atom) is preferably in the range of about 0.7 to 1.5.

A conventional 2, 3, 4 stream burner may be used to feed the partial oxidation gas generator with the fuel feedstream or feedstreams at a temperature in the range of about ambient to 250° F., the stream of free-oxygen containing gas at a temperature in the range of about ambient to 400° F., and optionally the stream of temperature moderator at a temperature in the range of about ambient to 500° F. In one embodiment, residual oil is passed through the central conduit of a three passage annulus-type burner, a pumpable aqueous slurry of coal is pumped through the intermediate annular passage, and a stream of free-oxygen containing gas e.g. oxygen is passed through the outer annular passage. For further information, about these burners, reference is made to coassigned U.S. Pat. Nos. 3,743,606; 3,874,592; and 4,525,175, which are incorporated herein by reference.

The feedstreams are reacted by partial oxidation without a catalyst in the reaction zone of a free-flow gas generator at an autogenous temperature in the range of about 1800° to 3000° F. and at a pressure in the range of about 2 to 300 atmospheres absolute (atm. abs.). The reaction time in the gas generator is about 1 to 10 seconds. The mixture of effluent gas leaving the gas generator may have the following composition (mole percent-dry basis) if it is assumed that the rare gases are negligible: CO 15 to 57, $H_2$ 70 to 10, $CO_2$ 1.5 to 50, $NH_3$ 0.02 to 2.0, HCl 0.001 to 1.0, HF 0.001 to 0.5, $CH_4$ 0.001 to 20, $N_2$ nil to 75, Ar nil to 2, $H_2S$ 0.01 to 5.0, and COS 0.002 to 1.0. Also entrained in the effluent gas stream from the gas generator is particulate matter comprising a material selected from the group consisting of particulate carbon, fly-ash, solid phase alkali metal compounds, and droplets of molten slag. Solid phase alkali metal compounds are selected from the group consisting of aluminosilicates, silicates, aluminates, sulfides, sulfates, halides, and hydroxides of sodium and/or potassium. The solid phase alkali metal compound particulate matter may be present up to about 5.0 wt. % of the particulate solids. The effluent gas stream from the gasifier may also contain trace amounts e.g. each less than about 200 ppm of vapor phase alkali metal compounds which are selected from the group consisting of hydroxides and halides of sodium and/or potassium, as well as metallic Na and/or K vapor. Unreacted particulate carbon (on the basis of carbon in the feed by weight) is about 0.05 to 20 weight percent.

A stream of hot raw effluent gas leaves through the central converging refractory lined bottom outlet in the reaction zone of the gas generator and passes through a vertical refractory lined T-shaped connecting duct. A portion of the hot raw gas stream designated B passes down through the connecting duct and then passes through a dip tube contained in a conventional quench tank. A suitable quench tank is shown and described in coassigned U.S. Pat. No. 2,818,326, which is incorporated herein by reference. The hot raw gas stream with entrained molten slag and/or fly ash from the reaction zone is cooled to a temperature in the range of about 250° F. to 800° F. by being directly quenched in a circulating stream of quench water located in the bottom of said quench tank. The temperature of the quench water is maintained at 200° F. to 600° F. by circulating it through an external cooling zone. Molten slag and/or fly ash separate from the fuel gas in the quench water to produce a saturated stream of clean gas. The clean gas stream C leaves the quench tank through a side outlet.

A refractory-lined side draw-off duct intersects the vertical leg of the T-shaped refractory lined connecting duct above the dip tube. A stream of hot raw gas A from the partial oxidation reaction zone is passed through the side draw-off duct. The amount of raw gas stream A relative to the amount of raw gas stream B is controlled by a first gas control valve in the quenched clean gas line D. For example, the volumetric ratio of raw gas stream A to raw gas stream B is in the range of about 19.0–1.0 to 1, such as about 8 to 1. While the volume of gas stream A is generally greater than that of gas stream B, most of the molten slag that is produced in the reaction zone of the gas generator falls by gravity and passes out of the central outlet in the reaction zone with the help of the slip stream of gas B. Slag is periodically removed from the bottom of the quench tank by means of a conventional lock hopper system, for example see coassigned U.S. Pat. No. 3,544,291, which is incorporated herein by reference.

A stream of quenched gas C leaves the first quench tank and is introduced into a knock-out pot or gas-liquid separator where entrained water and any remaining solid particulate matter are removed. The resulting stream of clean gas D is passed through the aforesaid first gas control valve. The stream of hot raw gas A at a temperature in the range of about 1800° F. to 3000° F. is passed through a hot gas deslagging zone, such as a conventional cyclone separator. A suitable high temperature slagging cyclone is shown in coassigned U.S. Pat. No. 4,328,006, which is incorporated herein by reference. A stream of hot deslagged gas E leaves from the top of the deslagging means, e.g., cyclone separator. Hot deslagged gas stream E at a temperature in the range of about 1800° F. to 3000° F. and clean gas stream D at a temperature in the range of about 250° F. to 800° F. are mixed together to produce hot gas stream H at a temperature in the range of about 1700° F. to 2300° F. A slip stream of gas F passes out from the bottom of the deslagging means carrying entrained separated slag and is cooled in water contained in the bottom of a second quench tank. A stream of quenched deslagged gas G is thereby produced and is passed through a second hot gas flow control valve. This valve controls the volumetric ratio of the volume of gas stream E leaving through the top of the deslagging means to the volume of gas slip-stream F, as follows: Gas Stream E/Gas Stream F=199–9.0 to 1, such as about 19.

Clean gas stream H at a temperature in the range of about 1700° F. to 2300° F. is cooled to a temperature in the range of about 1500° F. to 1850° F. and is mixed with the stream of quenched deslagged gas G to produce gas stream I. The volumetric ratio range of gas stream H to gas stream G is as follows: Gas Stream H/Gas Stream G=200–5.0 to 1, such as 12.

Mixed stream of gas I, having a temperature in the range of about 1475° F. to 1800° F., say about 1500° F., and containing the following gaseous impurities is thereby produced: ammonia, halides, solid and vaporized alkali metal compounds, and sulfur. The amount of particulate matter in gas stream I is less than 250 parts per million by weight (wppm). The maximum diameter of the particulate matter is about 10 microns.

Ammonia is the first gaseous impurity that is removed from the stream of gas I. Ammonia is removed first while the temperature of the gas stream is above 1475° F. At this temperature, the disproportionating catalyst is tolerant to sulfur in the gases. Further, the disproportionating reaction is favored by high temperatures. The nitrogen-containing compounds in the fuel feedstock to the partial oxidation reaction zone are converted into ammonia. Removal of $NH_3$ from a stream of gas will reduce the production of $NO_x$ gases during the subsequent combustion of the gas. In the next step of the process, in a high temperature ammonia decomposition catalytic reactor, about 90 volume % of the ammonia present in the reaction zone is disproportionated into $N_2$ and $H_2$. The expression "substantially ammonia-free" and "ammonia-free" as used herein means less than 150 to 225 volumetric parts per million (vppm) of $NH_3$. For example, the stream of gas having an inlet concentration of $NH_3$ in the range of about 500 and 5000 vppm (volumetric parts per million), say about 1900 vppm, and at a temperature in the range of about 1475° F. to 1800° F. and, at a pressure which is substantially that as provided in the reaction zone of the gas generator, less ordinary pressure drop in the lines, e.g., a pressure drop of about 0.5 to 3 atms., is passed through a fixed bed catalytic reactor where ammonia in the gas stream is disproportionated to $N_2$ and $H_2$. Readily available conventional nickel catalysts may be used. For example, HTSR-1 catalyst supplied by Haldor-Topsoe A/S, Copenhagen, Denmark and described in U.S. Department of Energy Morgantown, W. Va. Report DE 89000945, September 1988, which is incorporated herein by reference. The space velocity is in the range of about 3000 to 100,000 $h^{-1}$ (say, about 20,000 $h^{-1}$) at NTP. The catalyst is resistant to deactivation by halides and sulfur-containing gases at temperatures above 1475° F.

In the next step of the process, halides are removed from the ammonia-free process gas stream to produce an ammonia and halide-free gas stream. Gaseous halides are removed from the process gas stream prior to the final desulfurization step in order to prevent gaseous halide absorption by the desulfurization sorbent material and thereby deactivate the sorbent material. The terms "substantially halide-free," "halide-free," or "free from" halides, as used herein mean less than 1 vppm of halides. Gaseous halides, e.g., hydrogen chloride, and hydrogen fluoride, are removed by cooling the ammonia-free gas stream to a temperature in the range of about 1000° F. to 1300° F. prior to being contacted with a supplementary alkali metal compound or mixtures thereof, wherein the alkali metal portion of said supplementary alkali metal compound is at least one metal selected from Group 1A of the Periodic Table of the Elements. For example, the carbonates, bicarbonates, hydroxides and mixtures thereof of sodium and/or potassium, and preferably $Na_2CO_3$, may be injected into the cooled stream of clean ammonia-free gas. The supplementary alkali metal compound from an external source may be introduced as an aqueous solution or as a dry powder. Sufficient supplementary alkali metal is introduced so that substantially all of the gaseous halides, such as HCl and HF, react to form alkali metal halides, such as NaCl and NaF. For example, the atomic ratio of supplementary alkali metal to chlorine and/or fluorine is in the range of about 5-1 to 1, such as 2 to 1.

To separate the alkali metal halides from the gas stream, the gas stream is cooled to a temperature in the range of about 800° F. to 1000° F., by direct contact with a water spray, or, alternatively, by indirect heat exchange with a coolant. As the syngas cools to 800° to 1000° F., the alkali metal halide particles agglomerate along with the other very fine particles which passed through the previous raw syngas deslagging steps. The cooled gas is then filtered with a conventional high temperature ceramic filter, such as a ceramic candle filter, in order to remove the alkali metal halides and other particles such as the remaining alkali metal compounds and any remaining particulate matter such as particulate carbon or fly-ash. Over time, a dust cake of very fine particles accumulates on the dirty side of the ceramic filter. Periodically, the filter is back-pulsed with a gas such as nitrogen, steam or recycled syngas in order to detach the dust cake from the ceramic filter elements and to cause the detached cake to drop into the bottom of the filter vessel. In order to prevent reentrainment of the very fine dust particles, a very small slip-stream of the cooled gas stream entering the filter is withdrawn through the bottom of the filter vessel into a third quench tank similar to the ones mentioned previously. The volume of said slipstream of gas is about 0.1 to 0.01 volume percent of the gas stream entering the filter. The remainder of the syngas passes through the ceramic filter elements and exits the filter free of ammonia, halides, alkali metal compounds and virtually all other compounds which are solid particulates in the filtration temperature range of 800° F. to 1000° F. The combined stream, consisting of the small slip-stream of syngas and the fine dust cake which is periodically detached from the ceramic filter elements, is quenched with water in the third quench tank. The various compounds and particles in the dust cake either dissolve or are suspended in the quench water. The resulting gas stream free from ammonia, halide, alkali metal compounds, and particulate matter leaves the quench zone, passes through a flow control valve, and is mixed with the overhead stream of gas free from ammonia, halide, alkali metal compounds, leaving the gas filtration zone. The temperature of this combined halide and ammonia-free stream of gas is in the range of about 800° F. to 1000° F. The pressure is substantially that in the partial oxidation reaction zone, less ordinary pressure drop in the lines, e.g. about 1 to 4 atms.

In the next gas purification step, the process gas stream is desulfurized in a conventional high temperature gas desulfurization zone. However, in order for the desulfurization reactions to proceed at a reasonable rate, the gas stream free from particulate matter, ammonia, alkali metal compounds and halides should be at a temperature in the range of 1000° F. to 1250° F. If the gas has been cooled to only 1000° F. in the preceding cooling and filtering step, then no reheating would normally be required. But if the gas was cooled to 800° F. in the preceding step, then it should be reheated using one of the following methods.

Heating the gas stream free from particulate matter, ammonia, alkali metal compound, and halides to a temperature in the range of about 1000° F. to 1250° F. while simultaneously increasing its mole ratio of $H_2$ to CO may be done in a catalytic exothermic watergas shift reactor using a conventional high temperature sulfur resistant shift catalyst, such as a cobalt-molybdate catalyst. Simultaneously, the $H_2$/CO mole ratio of the hydrogen and carbon monoxide in the feed gas stream to the shift reactor is increased. For example, the shifted gas stream may have a $H_2$/CO mole ratio in the range of about 1.0–17/1. Alternatively, the temperature of the gas stream may be increased to the desired temperature by passing the halide and ammonia-free process gas stream over a conventional high temperature sulfur resistant methanation catalyst, such as ruthenium on alumina. Another suitable method for increasing the temperature of the process gas stream is by indirect heat exchange. By this means, there is no change in gas composition of the portion of the process gas stream being heated.

The heated gas stream free from particulate matter, ammonia, alkali metal compound, and halides at a temperature in the range of about 1000° F. to 1250° F. is mixed with regenerated sulfur-reactive mixed metal oxide sorbent material, such as zinc titanate, at a temperature in the range of about 1000° F. to 1450° F. and the mixture is introduced into a fluidized bed. Mixed metal oxide sulfur absorbent materials comprise at least one, such as 1 to 3, sulfur reactive metal oxides and about 0 to 3 nonsulfur reactive metal oxides. Greater than 99 mole percent of the sulfur species in the process gas stream are removed external to the partial oxidation gas generator in this fluidized bed. The term "zinc titanate sorbent" is used to describe mixtures of zinc oxide and titania in varying mole ratios of zinc to titanium in the range of about 0.5–2.0/1, such as about 1.5. At a temperature in the range of about 1000° F. to 1250° F., and at a pressure of that in the gas generator in (1) less ordinary pressure drop in the lines, the sulfur containing gases, e.g., $H_2S$ and COS, in the gas feedstream free from particulate matter, ammonia, halide, and alkali metal compounds react in said fluidized bed with the reactive oxide portion, e.g. zinc oxide, of said mixed metal oxide sulfur sorbent material to produce a sulfided sorbent material comprising solid metal sulfide material and the remainder, e.g. titanium dioxide, of said sorbent material. In addition to the desulfurization reactions, mixed metal oxide sulfur sorbents such as zinc titanate also catalyze the water-gas shift reaction essentially to completion in the same range of temperatures at which desulfurization takes place. Because there will still be an appreciable amount of water in the syngas at the desulfurizer inlet, the shift reaction will proceed simultaneously with the desulfurization reactions in the fluidized bed desulfurizer. This will be the case even if a shift catalyst reactor is used as a reheating step prior to the desulfurizer. The desulfurization and shift reactions are exothermic, and the released heat will tend to raise the temperature of the syngas and sorbent. The temperature of the sorbent, however, must be prevented from exceeding about 1250° F. in order to minimize reduction, volatilization and loss of the reactive metal component, e.g. zinc, of the sorbent. If the amount of heat released by the desulfurization and shift reactions would tend to raise the temperature of the fluidized bed above about 1250° F., internal cooling coils may be employed in order to prevent the temperature of the mixed metal oxide sorbent from exceeding 1250° F. Alternatively, if the temperature of the syngas is, say 1000° F. at the desulfurizer inlet, and if the composition of the syngas is such that the heat from the desulfurization and shift reactions will not raise the temperature of the syngas above 1250° F., then no fluidized bed internal cooling coils are needed. The reactive oxide portion of said mixed metal oxide sulfur sorbent material is selected from the group consisting of Zn, Fe, Cu, Ce, Mo, Mn, Sn, and mixtures thereof. The non-reactive oxide portion of said sulfur sorbent material may be an oxide and/or an oxide compound selected from the group consisting of titanate, aluminate, aluminosilicates, silicates, chromites, and mixtures thereof.

The overhead from the fluidized bed desulfurizer is introduced into a first conventional high temperature gas-solids separating zone, e.g., cyclone separator, where entrained sulfided sulfur sorbent particles are removed from the gas leaving the fluidized bed desulfurizer. The overhead stream from the separating zone comprises ammonia-free, halide-free, alkali metal compound-free, and sulfur-free gas. Any remaining particulate matter entrained from the fluidized bed may be removed from this gas stream in a conventional high temperature ceramic filter such as a ceramic candle filter, which removes all remaining particles. The exit concentrations of sulfur species in the sulfur-free product gas stream is less than 25 vppm, say 7 vppm. Depending upon the type and amount of gaseous constituents, and the use it is put to, the product gas stream may be referred to as synthesis gas, fuel gas, or reducing gas. For example, the mole ratio $H_2/CO$ may be varied for synthesis gas and reducing gas, and the $CH_4$ content may be varied for fuel gas. The sulfided sorbent exiting from the bottom of high temperature cyclone and from the bottom of the ceramic filter has a sulfur loading of about 5–20 weight percent and a temperature of about 1000° F. to 1250° F. It is then introduced into a conventional fluidized bed regenerator where the metal sulfide is roasted, reacted with air at a temperature in the range of about 1000° F. to 1450° F., and reconverted into said sulfur-reactive mixed metal oxide sorbent material which is recycled to said external high temperature gas desulfurization zone in admixture with said sulfur containing process feed gas which is free from particulate matter, ammonia, halide, and alkali metal compound.

In one embodiment, regenerated zinc titanate powder is injected into said gas stream free from particulate matter, ammonia, halide and alkali metal compound at a temperature in the range of about 1000° F. to 1250° F. Then the gas-solids mixture is introduced into the fluidized bed desulfurizer. The rate of injection of zinc titanate powder into the stream of gases being desulfurized is sufficient to ensure complete desulfurization. The fluidized bed of zinc titanate (converted at least in part to the sulfided form of the sorbent) is carried over with the desulfurized gas stream to a cyclone separator where spent zinc titanate is separated and flows down into the regenerator vessel. The hot desulfurized overhead gas stream from the cyclone separator is filtered and cleaned of any residual solids material and then burned in the combustor of a gas turbine for the production of flue gas with a reduced $NO_x$ content and free from particulate matter, ammonia, halide, alkali metal compound, and sulfur. The flue gas is then passed through an expansion turbine for the production of mechanical and/or electrical power. After heat exchange with boiler feed water to produce steam, the spent flue gas may be safely discharged into the atmosphere. In one embodiment, the by-product steam may be passed through a steam turbine for the production of mechanical and/or electrical energy. All of the fine solids separated from the sulfur-free gas stream are returned to the fluidized bed regenerator where the sulfide particles are oxidized by air at a temperature in the range of about 1000° F. to 1450° F. Regenerated sorbent entrained in air and $SO_2$ are carried over to a second cyclone separator. The fine solids that are separated from the stream of gases in the cyclone separator are recycled to the fluidized bed regenerator. The gaseous overhead from the cyclone separator is filtered and the clean $SO_2$-containing gas stream containing about 5.5 to 13.5 mole % $SO_2$, e.g. 11.3 mole % $SO_2$ at a temperature in the range of about 1000° F. to 1450° F. may be cooled, depressurized and used in well known processes for producing sulfuric acid e.g. Monsanto Chemical Co. contact process.

In another embodiment, the recombined deslagged raw stream of synthesis gas, fuel gas, or reducing gas in line 44 of the drawing is used as produced. In still another embodiment, acid gases may be removed from this stream by conventional low temperature acid gas removal steps. In such case the gas stream in line 44 at a temperature in the range of about 1475° F. to 1800° F. is first scrubbed with water to remove particulate matter, alkali metal compounds, halides, and ammonia. The clean process gas stream is then cooled to a temperature in the range of about −70° F. to 250° F. and introduced into a conventional acid-gas removal zone (AGR) where at least one gas from the group consisting of $CO_2$, $H_2S$ and COS is removed. Suitable conventional acid gas removal means are described in coassigned U.S. Pat. No. 4,052,176, which is incorporated herein by reference. In the low temperature acid-gas removal zone (AGR), suitable conventional processes may be used involving refrigeration and physical or chemical absorption with solvents, such as methanol, n-methylpyrrolidone, triethanolamine, propylene carbonate, or alternatively with amines or hot potassium carbonate. The $H_2S$ and COS containing solvent may be regenerated by flashing and stripping with nitrogen, or alternatively by heating and refluxing at reduced pressure without using an inert gas. The $H_2S$ and COS are then converted into sulfur by a suitable process. For example, the Claus process may be used for producing elemental sulfur from $H_2S$ as described in Kirk-Othmer Encyclopedia of Chemical Technology, Second Edition, Volume 19 John Wiley 1969 Page 3530, which is incorporated herein by reference.

DESCRIPTION OF THE DRAWING

A more complete understanding of the invention may be had by reference to the accompanying schematic drawing FIG. 1, which shows the process in detail. Although the drawing illustrates a preferred embodiment of the process of this invention, it is not intended to limit the continuous process illustrated to the particular apparatus or materials described.

As shown in the drawing FIG. 1, vertical free-flow non-catalytic refractory lined gas generator 1 is equipped with conventional annulus type burner 2 having coaxial central and annular passages 3 and 4 respectively. While a two stream annular-type burner is shown herein, it is understood that other suitable conventional burners with a plurality of separate passages may be used to accommodate two or more separate feedstreams. Burner 2 is mounted in the upper inlet 5 of generator 1. Central passage 3 is connected to a stream of free oxygen containing gas in line 6. A pumpable aqueous slurry of solid carbonaceous fuel is passed through line 7 and into the annular passage 4. The streams of free-oxygen containing gas and the aqueous slurry of solid carbonaceous fuel impact together, atomize, and react together by partial oxidation in reaction zone 8 of gas generator 1 to produce hot raw gas comprising: $H_2$, CO, $CO_2$, $H_2O$, $CH_4$, $NH_3$, HCl, HF, $H_2S$, COS, $N_2$, Ar, and containing particulate matter, vapor phase alkali metal compounds, fly-ash and/or molten slag. The hot raw gas leaving the downstream central exit passage 9 of reaction zone 8 is passed through a refractory lined duct 10 where a comparatively small slip-stream of raw gas B carrying most of the slag passes down through refractory lined vertical leg 11.

The remaining raw gas stream, which comprises most of the raw gas stream, leaves through intersecting refractory lined side draw off duct 12 as raw gas stream A. Raw gas stream B passes through dip tube 15 and is quenched and scrubbed with water 16 contained in the bottom of gas quench tank 17. Periodically, quench water containing slag and particulate matter is removed through conventional lockhopper system 18 and line 19. A clean stream of raw gas C is removed from quench tank 17 through line 20 and passed into de-mister equipped knockout pot 21 where entrained water and particulate matter are removed to produce a stream of dewatered raw gas D in line 22. Water leaves chamber 21 through lines 23 and 24.

Raw gas stream A comprises most of the gas produced in gasifier 1 and is passed through line 26, into deslagging cyclone 30. A slip stream F of hot raw gas containing entrained molten ash is withdrawn through line 31 and passed into quench tank 32 where it is scrubbed with water 33 contained in the bottom of quench tank 32. The quenched solids are periodically removed through a conventional lockhopper system 34 and line 35. Substantially slag-free gas stream E leaves deslagging cyclone 30 through line 36 and is recombined in line 37 with the slag-free gas stream D from line 22, flow control valve 38 and line 39 to produce substantially slag-free gas stream H. Gas stream H is cooled in cooler 40 by indirect heat exchange with boiler feed water which enters through line 41 and leaves as saturated steam through line 42. Cooled gas stream H is passed through line 43 and further cooled in line 44 by the addition of slip stream of gas G which is withdrawn from quench chamber 32 by way of line 45, control valve 46, and line 47.

Quench water 16 is sent to conventional water recovery zone 53 by way of lines 54 and 55. Quench water 33 is sent to the same water recovery zone 53 by way of lines 51, 52, 24, and 55 Water from knock-out pot 21 is passed through lines 23, 24, and 55 into water recovery zone 53. Reclaimed water leaves quench water recovery zone through line 56 and is passed through line 57 into quench chamber 17. Fresh make-up water is introduced into the system through line 58. Particulate carbon and fly-ash leaves water recovery zone 53 through lines 59 and 60, respectively. Recycle water for quench tank 33 is passed through lines 56, 61 and 62.

The mixture of gas streams G and H in line 44 is called gas stream I. This stream is passed through ammonia decomposition reactor 63 where ammonia in the gas stream is decomposed to $N_2$ and $H_2$. The substantially $NH_3$-free stream of gas leaving reactor 63 through line 64 is further cooled in a conventional cooler 65 by indirect heat exchange with boiler feed water which enters cooler 65 through line 66 and leaves as saturated steam through line 67.

HCl and/or HF are removed from the stream of $NH_3$-free fuel gas in line 68 by mixing this stream in line 69 with an alkali metal compound e.g. $Na_2CO_3$ which is injected from line 70. The gaseous mixture is passed through line 75, valve 76, line 77, and, optionally, mixed in lines 78 and 79 with water from line 71, valve 72, and line 80. Optionally, the stream of gas in line 69 may be further cooled by passage through line 81, valve 82, line 83, cooler 84 and line 85. In cooler 84, boiler feed water in line 86 is converted into saturated steam which leaves through line 87.

An alkali metal halide compound, e.g., NaCl in solid form is separated from the gas stream in filter vessel 88.

A back-flushing stream of nitrogen gas is periodically introduced into filter vessel 88 by way of line 89 to pulse-clean the filters. Substantially halide-free gas stream leaves filter 88 through line 90 and is mixed in line 91 with cleaned slip stream of gas from line 92. Alkali metal halides e.g. NaCl, NaF, in solid form plus other solid alkali metal compounds and residual fine particulate matter in a small slip stream of gas from filter chamber 88 is passed through line 93 into quench chamber 94 where the alkali metal halides, other alkali metal compounds, and residual particulate matter dissolve or are suspended in water 95. The ammonia and halide-free slip stream of gas from quench chamber 94 is passed through line 96, valve 97, and line 92. Quench water 95 leaves chamber 94 and passes into water recovery zone 53 by way of line 98, valve 99, and lines 100, 52, 24, and 55. Quench water from vessels 94, 32, 21, and 17 may be combined and passed through line 55 into conventional quench water recovery zone 53. Recycle water is passed through lines 56, 57, 61, 62, and 101 into the respective quench vessels.

The stream of gas in line 91 which is substantially free from particulate matter, ammonia, halide and alkali metal compound is, optionally, at least in part water-gas shifted by being passed through line 110, valve 111, line 112, shift catalyst chamber 113, line 114 and 115. Alternatively, at least a portion of the stream of gas in line 91 may by-pass shift catalyst chamber 113 by passing through line 117, valve 118, and line 119. In another embodiment, shift catalyst chamber 113 is replaced with a methanation catalyst chamber.

A sulfur reactive mixed metal oxide sorbent material, such as zinc titanate, from line 125 is mixed in line 116 with the stream from line 115. Then the mixture is introduced into a fluidized bed reactor 126 where the gas stream is desulfurized at an elevated temperature, e.g. 1000° F. to 1250° F. For example, as shown in FIG. 1, contacting vessel 126 is a fluidized bed and at least a portion of the sulfur-reactive portion of said mixed metal oxide material reacts with sulfur-containing gas in said gas stream from line 115 and is converted into a solid metal sulfide-containing material. A gas stream substantially free from halide, ammonia, alkali metal compound and sulfur and having entrained solid metal sulfide-containing particulate sorbent material is produced and passed through overhead passage 127 into conventional gas-solids separator 128, e.g., cyclone separator. A gas stream free from halides, ammonia, alkali metal compound and sulfur at a temperature of at least 1000° F. is removed from separator 128 by way of overhead line 129. Spent solid metal sulfide-containing particulate sorbent material is removed from gas-solids separator 128 by way of bottom line 130, valve 131, line 132, and is introduced into sulfided particulate sorbent regenerator vessel 133. In one embodiment, any solid metal sulfide-containing particulate sorbent material remaining in the gas stream in line 129 is filtered out in conventional high temperature ceramic filter 134 to produce a hot clean gas stream which is substantially free from particulate matter, ammonia, halide, alkali metal compound, and sulfur in line 135 having a temperature of at least 1000° F. A clean upgraded fuel gas stream in line 135 may be introduced into the combustor of a combustion turbine for the production of electrical and/or mechanical power. In another embodiment, clean ungraded synthesis gas in line 135 is introduced into a catalytic reaction zone for the chemical synthesis of organic chemicals, e.g., methanol. Nitrogen in line 136 is used to periodically back flush and clean ceramic filter 134. The nitrogen may be obtained as a by-product from a conventional air separation unit used to make substantially pure oxygen from air. The oxygen is fed to the partial oxidation gas generator.

Spent solid metal sulfide-containing particulate sorbent material is removed from gas-solids separator 134 by way of line 140, valve 141, line 142, and introduced into metal sulfide-containing particulate sorbent regenerator vessel 133. For example, regenerator vessel 133 may be a conventional bubbling or circulating fluidized bed with air being introduced through line 143. The air may be obtained as a slip-stream from the air compressor of the downstream combustion turbine in which the clean fuel gas is combusted to produce mechanical and/or electrical power. Boiler feed water is passed through line 144 and coil 145, and exits as saturated steam through line 146. The metal sulfide-containing sorbent is oxidized by the air from line 143 to produce sulfur dioxide and sulfur reactive metal oxide-containing sorbent particulates which are entrained with the gases that pass through passage 147 into gas-solids separator 148. For example, gas-solids separator 148 may be a cyclone separator. Reconverted sulfur-reactive metal oxide-containing material is passed through line 150 and recycled to the bottom of regenerator vessel 133 and then through line 151, valve 152, lines 153,125 to line 116 where it is mixed with the sulfur-containing gas stream from line 115. Make-up sulfur-reactive metal oxide-containing material is introduced into the process by way of line 154, valve 155, and line 156. A gas stream substantially comprising $N_2$, $H_2O$, $CO_2$, $SO_2$ and particulate matter leaves separator 148 through overhead line 160 and is introduced into high temperature ceramic filter 161 where fine regenerated sulfur-reactive metal oxide-containing material is separated and removed through valve 162, lock hopper chamber 163, valve 164 and line 165. The hot stream of clean sulfur-containing gas is discharged through line 166 and sent to a conventional sulfur recovery unit (not shown). Periodically, nitrogen is passed through line 167 for reverse flushing and cleaning the ceramic filter.

Other modifications and variations of the invention as hereinbefore set forth may be made without departing from the spirit and scope thereof, and therefore only such limitations should be imposed on the invention as are indicated in the appended claims.

We claim:

1. A partial oxidation process for producing hot, clean synthesis gas, reducing gas, or fuel gas product substantially free from particulate matter, ammonia, halides, alkali metal compounds and sulfur-containing gases comprising:

(1) reacting a hydrocarbonaceous fuel comprising a solid carbonaceous fuel with or without liquid hydrocarbonaceous fuel or gaseous hydrocarbon fuel with a free-oxygen containing gas in a free-flow vertical refractory lined partial oxidation gas generator to produce a hot raw gas stream having a temperature in the range of about 1800° F. to 3000° F. and comprising $H_2$, CO, $CO_2$, $H_2O$, $CH_4$, $NH_3$, HCl, HF, $H_2S$, COS, $N_2$, Ar and containing particulate matter, vapor phase alkali metal compounds, and molten slag; wherein said hydrocarbonaceous fuel contains halides, alkali metal compounds, sulfur, nitrogen and inorganic ash containing components;

(2) splitting the stream of hot raw gas from (1) into two separate hot raw gas streams A and B;

(3) introducing hot raw gas stream A at a temperature in the range of about 1800° F. to 3000° F. into a gas deslagging zone, removing molten slag and a slip-stream of hot raw gas from said gas deslagging zone and separating said molten slag from said slip-stream of hot raw gas in a gas quenching zone to produce a quenched slag-free stream of raw gas G; and removing a hot raw gas stream E substantially free from particulate matter and molten slag from said gas deslagging zone;

(4) quenching hot raw gas stream B in water, separating out slag and particulate matter, and separating a clean stream of water-saturated raw gas C from the quench water;

(5) dewatering and demisting raw gas stream C to produce raw gas stream D; and mixing together streams of raw gas D and raw gas E to produce raw gas stream H at a temperature in the range of about 1700° F. to 2300° F.; and cooling raw gas stream H by indirect heat exchange to a temperature in the range of about 1500° F. to 1850° F.;

(6) thereafter mixing together raw gas streams G and H to produce raw gas stream I, having a temperature in the range of about 1475° F. to 1800° F. and catalytically disproportionating the ammonia in gas stream I into nitrogen and hydrogen, thereby producing ammonia-free gas stream J; cooling the ammonia-free gas stream J to a temperature in the range of about 1000° F. to 1300° F.; and introducing supplemental alkali metal compound into the cooled gas stream J to react with gaseous halides present in said gas stream J; further cooling and filtering the resulting gas stream J, and separating therefrom alkali metal halides, any remaining alkali metal compounds, and any remaining particulate matter; and (7) contacting the cooled and filtered gas stream J from (6) with a sulfur reactive metal oxide containing mixed metal oxide sulfur sorbent material in a sulfur-removal zone, wherein the sulfur-containing gases in the cooled and filtered gas stream J from (6) react with said sulfur reactive oxide containing mixed metal oxide sorbent material to produce a sulfided sorbent material; and separating said sulfided sorbent material from the cooled and filtered gas stream J to produce a clean product gas stream substantially free from ammonia, alkali metal compound, halides, sulfur and having a temperature of at least 1000° F.

2. The process of claim 1 provided with the step of filtering said product gas stream from (7) to remove any remaining particulate matter.

3. The process of claim 1 wherein said solid carbonaceous fuel is selected from the group consisting of coal, lignite, particulate carbon, petroleum coke, concentrated sewage sludge, and mixtures thereof.

4. The process of claim 1 wherein said solid carbonaceous fuel has a sulfur content in the range of about 0.1 to 10 wt. %, a halide content in the range of about 0.01 to 1.0 wt. %, and a nitrogen content in the range of about 0.01 to 2.0 wt. %.

5. The process of claim 1 wherein said sulfur containing components of the hydrocarbonaceous fuel are present as sulfides and/or sulfates selected from the group consisting of Na, K, Ca, Mg, Fe, Al, Si, and mixtures thereof.

6. The process of claim 1 wherein said halide components of said hydrocarbonaceous fuel are chlorine and/or fluorine compounds selected from the group consisting of Na, K, Ca, Mg, Al, Fe, Si, and mixtures thereof.

7. The process of claim 1 wherein said nitrogen component of said hydrocarbonaceous fuel is present as nitrogen containing inorganic or organic compounds.

8. The process of claim 1 where in (2) the volumetric ratio of raw gas stream A to raw gas stream B is in the range of about 19.0–1.0 to 1.

9. The process of claim 1 where in (6) said disproportionating takes place at a temperature in the range of about 1475° F. to 1800° F. and in the presence of a nickel catalyst.

10. The process of claim 1 where in (6) the alkali metal in said supplementary alkali metal compound is at least one metal selected from Group 1A of the Periodic Table of the Elements.

11. The process of claim 1 where in (6) said supplementary alkali metal compound is selected from carbonates, bicarbonates, hydroxides and mixtures thereof of sodium and/or potassium.

12. The process of claim 1 where in (6) dry powdered $Na_2CO_3$ or an aqueous solution of $Na_2CO_3$ is injected into cooled ammonia-free gas stream J as said supplementary alkali metal compound.

13. The process of claim 1 provided with the step of passing the process gas stream from (6) through a catalytic water-gas shift reaction zone and thereby heating said process gas stream to a temperature in the range of about 1000° F. to 1250° F. prior to (7).

14. In the process of claim 13 wherein the $H_2/CO$ mole ratio of the shifted gas stream is in the range of about 1.0–17/1.

15. The process of claim 1 provided with the step of passing the process gas stream from (6) through a catalytic methanation reaction zone and thereby heating said process gas stream to a temperature in the range of about 1000° F. to 1250° F. prior to (7).

16. The process of claim 1 where in (6) said gas stream I contains not more than 250 wppm of particulate matter having a maximum diameter of 10 microns.

17. The process of claim 1 provided with the step of heating the stream of gas from (6) to a temperature in the range of about 1000° F. to 1250° F. by indirect heat exchange prior to (7).

18. The process of claim 1 where in (7) the sulfur-reactive metal oxide portion of said sulfur-reactive mixed metal oxide sulfur sorbent material is selected from the group consisting of Zn, Fe, Cu, Ce, Mo, Mn, Sn, and mixtures thereof.

19. The process of claim 1 where in (7) the sulfur-reactive mixed metal oxide sulfur sorbent material contains a non-reactive portion comprising an oxide and/or an oxide compound selected from the group consisting of titanate, aluminate, aluminosilicates, silicates, chromites, and mixtures, thereof.

20. The process of claim 1 wherein $H_2S$ and COS are produced in gas stream J from (6) and react with the sulfur-reactive portion of said sulfur-reactive mixed metal oxide material in (7).

21. The process of claim 1 provided with the step of roasting said sulfided sorbent material separated in (7), regenerating said sulfur-reactive mixed metal oxide sorbent material, and separating said sulfur-reactive mixed metal oxide sorbent material for use in (7) from a $SO_2$-containing gas stream.

22. The process of claim 21 provided with the steps of filtering said $SO_2$-containing gas stream, and using the filtered $SO_2$-containing gas stream to make sulfuric acid.

23. The process of claim 1 wherein said liquid hydrocarbonaceous fuel is selected from the group consisting of liquefied petroleum gas, petroleum distillates and residues, gasoline, naphtha, kerosine, crude .petroleum, asphalt, gas oil, residual oil, tar sand and shale oil, coal oil, aromatic hydrocarbons, coal tar, cycle gas oil from fluid-catalytic-cracking operation, furfural extract of coker gas oil, tire-oil, and mixtures thereof.

24. The process of claim 1 wherein said gaseous hydrocarbon fuel is selected from the group consisting of methane, ethane, propane, butane, pentane, natural gas, water-gas, coke-oven gas, refinery gas, acetylene tail gas, ethylene off-gas, synthesis gas, and mixtures thereof.

25. A partial oxidation process for the production of a stream of hot clean fuel gas substantially free from particulate matter, ammonia, alkali metal compounds, halides and sulfur-containing gas for use as synthesis gas, reducing gas, or fuel gas comprising:

(1) reacting a pumpable aqueous slurry of solid carbonaceous fuel containing halide, sulfur, nitrogen and inorganic ash containing components with a free-oxygen containing gas at a temperature in the range of about 1800° F. to 3000° F., a pressure in the range of about 2 to 300 atmospheres, a weight ratio of $H_2O$ to solid carbonaceous fuel in the range of about 0.1 to 5.0, and an atomic ratio of O/C in the range of about 0.7 to 1.5 in a free-flow vertical refractory lined partial oxidation gas generator to produce a hot raw fuel gas stream having a temperature in the range of about 1800° F. to 3000° F. and comprising $H_2$, CO, $CO_2$, $H_2O$, $CH_4$, $NH_3$, HCl, HF, $H_2S$, COS, $N_2$, Ar and containing particulate matter, vapor phase alkali metal compounds and molten slag;

(2) splitting the stream of hot raw fuel gas from (1) into two separate hot raw fuel gas streams A and B; wherein the volumetric ratio of raw fuel gas stream A to raw fuel gas stream B is in the range of about 19.0–1.0 to 1;

(3) introducing hot raw fuel gas stream A at a temperature in the range of about 1800° F. to 3000° F. into a gas deslagging zone, removing molten slag and a slip-stream of hot raw fuel gas from said gas deslagging zone and separating said molten slag from said stream of hot raw fuel gas in a gas quenching zone to produce a slag-free stream of raw gas G; and removing slag-free hot raw fuel gas stream E from said gas deslagging zone;

(4) quenching raw fuel gas stream B in water, separating out slag and particulate matter, and separating a clean stream of raw fuel gas C from the quench water;

(5) dewatering and demisting raw fuel gas stream C to produce raw fuel gas stream D; and mixing together streams of raw fuel gas D and raw fuel gas E to produce raw fuel gas stream H at a temperature in the range of about 1700° F. to 2300° F.; and cooling raw fuel gas stream H by indirect heat exchange to a temperature in the range of about 1500° F. to less than 1850° F.;

(6) mixing together raw fuel gas streams G and H to produce raw fuel gas stream I, and catalytically disproportionating the ammonia in said fuel gas stream I into nitrogen and hydrogen, thereby producing ammonia-free fuel gas stream J; cooling the ammonia-free fuel gas stream J to a temperature in the range of about 1000° F. to 1300° F.; and introducing $Na_2CO_3$ into the cooled fuel gas stream J to react with the HCl and/or HF present in said fuel gas stream; cooling to a temperature in the range of about 800° F. to 1000° F. and filtering the resulting fuel gas stream J, and separating out NaCl and/or NaF to produce gas stream J free from particulate matter, ammonia, alkali metal compounds, HCl and/or HF;

(7) contacting the gas stream J from (6) with zinc titanate sorbent material in a sulfur-removal zone at a temperature in the range of about 1000° F. to 1250° F. and at a pressure of that in the gas generator in (1) less ordinary pressure drop in the lines, wherein the $H_2S$ and/or COS gases in said gas stream J from (6) react with the zinc oxide-containing portion of said zinc titanate sorbent material to produce a sulfided sorbent material; and separating said sulfided sorbent material from the stream of gas J to produce a fuel gas stream free from ammonia, alkali metal compounds, halides, sulfur and having a temperature of at least 1000° F.; and (8) separating any remaining particulate solids from the stream of fuel gas from (7) to produce a clean product gas stream of fuel gas substantially free from particulate matter, $NH_3$, HCl and/or HF, and sulfur-containing materials and having a temperature of at least 1000° F.; and burning said product fuel gas stream in the combustor of a gas turbine for the production of flue gas which is free from particulate matter, ammonia, alkali metal compounds, halides, sulfur, and passing said flue gas through an expansion turbine for the production of mechanical and/or electrical power.

26. The process of claim 25, including the step of roasting said sulfided sorbent material separated in (7), and regenerating said zinc titanate sorbent for use in (7).

27. A partial oxidation process for the production of a raw stream of synthesis gas, reducing gas or fuel gas comprising:

(1) reacting a hydrocarbonaceous fuel comprising a solid carbonaceous fuel with or without liquid hydrocarbonaceous fuel or gaseous hydrocarbon fuel with a free-oxygen containing gas in a free-flow vertical refractory lined partial oxidation gas generator to produce a hot raw gas stream having a temperature in the range of about 1800° F. to 3000° F. and comprising $H_2$, CO, $CO_2$, $H_2O$, $CH_4$, $NH_3$, HCl, HF, $H_2S$, COS, $N_2$, Ar and containing particulate matter, vapor phase alkali metal compounds, and molten slag; wherein said hydrocarbonaceous fuel contains halides, alkali metal compounds, sulfur, nitrogen and inorganic ash containing components;

(2) splitting the stream of hot raw gas from (1) into two separate hot raw gas streams A and B; wherein the volumetric ratio of raw gas stream A to raw gas stream B is in the range of about 19.0–1.0 to 1.0;

(3) introducing hot raw gas stream A at a temperature in the range of about 1800° F. to 3000° F. into a gas deslagging zone, removing molten slag and a slip-stream of hot raw gas from said gas deslagging zone and separating said molten slag from said slip-stream of hot raw gas in a gas quenching zone to produce a quenched slag-free stream of raw gas G; and removing a hot raw gas stream E substantially free from particulate matter and molten slag from said gas deslagging zone;

(4) quenching hot raw gas stream B in water, separating out slag and particulate matter, and separating a clean stream of water-saturated raw gas C from the quench water;

(5) dewatering and demisting raw gas stream C to produce raw gas stream D; and mixing together streams of raw gas D and raw gas E to produce raw gas stream H at a temperature in the range of about 1700° F. to 2300° F.; and cooling raw gas stream H by indirect heat exchange to a temperature in the range of about 1500° F. to 1850° F.; and (6) mixing together raw gas streams G and H to produce raw gas stream I.

28. The process of claim 27 including the steps of scrubbing the raw gas stream I from (6) with water to remove particulate matter, alkali metal compounds, halides and ammonia, cooling the gas stream I to a temperature in the range of about −70° F. to 250° F., and introducing the cooled gas stream I into an acidgas removal zone where at least one gas from the group consisting of $CO_2$, $H_2S$, and COS is removed from the gas stream I.

* * * * *